United States Patent [19]

Legatti

[11] Patent Number: 4,567,456

[45] Date of Patent: Jan. 28, 1986

[54] RESETTABLE CIRCUIT CLOSING DEVICE

[75] Inventor: Raymond H. Legatti, Clearwater, Fla.

[73] Assignee: Technology Research Corporation, Clearwater, Fla.

[21] Appl. No.: 503,868

[22] Filed: Jun. 13, 1983

[51] Int. Cl.[4] ..... H01H 73/00; H01H 83/00; H01H 3/00

[52] U.S. Cl. ..... 335/20; 335/166; 335/186

[58] Field of Search ..... 335/1, 2, 18, 19, 20, 335/164, 166, 186, 190; 361/42, 43, 44, 45, 92

[56] References Cited

U.S. PATENT DOCUMENTS 4,048,599 9/1977 Groth ..... 335/20
4,086,643 4/1978 Jacobs ..... 361/92
4,209,762 6/1980 Samborski et al. ..... 335/18
4,376,895 3/1983 Meister ..... 335/186

*Primary Examiner*—Harold Broome
*Attorney, Agent, or Firm*—Haight, Hofeldt, Davis & Jambor

[57] ABSTRACT

A resettable contact closing device opens a load circuit connected to a power line protected by a ground fault interrupter circuit, if the neutral conductor is broken. The contacts are closed by a mechanical reset actuator only if a solenoid is energized by a potential proportional to the line-to-neutral voltage to hold the actuator in a contact closing position. If the neutral conductor is broken, the solenoid will not be energized and the contacts, and hence the power line to the load circuit, will be opened.

16 Claims, 5 Drawing Figures

RESETTABLE CIRCUIT CLOSING DEVICE

BACKGROUND OF THE INVENTION

1. Field of the Invention

This invention relates generally to a circuit closing device that is disabled by an undervoltage condition, and more specifically, this invention relates to a circuit closing device that opens a power line protected by a ground fault current interrupter circuit in the event that the neutral conductor is broken.

2. Description of the Prior Art

Ground fault current interrupter circuits are in general usage to protect people and equipment from undesired ground fault currents. These ground fault current interrupter circuits have conventionally been mounted in fixed locations, such as, for example, in association with an electrical outlet. Accordingly, the size of the ground fault current interrupter circuit, within limits, has not been a significant problem.

As the technology in this area has advanced, other uses for ground fault current interrupter circuits have been considered. As a result, many applications for ground fault current interrupter circuits in which a fixed mounting is not possible have been eyed. Accordingly, various efforts have been made to develop a ground fault current interrupter circuit that could be incorporated into a plug or portable receptacle. As currently existing, the results of these efforts have produced devices that have been undesirably bulky and unduly costly.

One of the difficulties that is encountered in portable situations is that the possibility of a broken neutral conductor is greatly increased. This means that you could still have a potentially dangerous fault from the "hot" or "live" power line to ground, but there would be no power across the ground fault current interrupter circuit to provide the desired protection. Therefore, Underwriters Laboratories has a requirement that all non-permanently connected ground fault current interrupter circuits must be protected against the possibility of a broken neutral conductor.

Currently available systems including such protection against a broken neutral conductor employ a relay energized from the power line to close the circuit from the power to the load. While such an approach is effective to protect against a broken neutral conductor, since a broken neutral would result in de-energization of the relay and hence breaking of the power line to a load, the relays required are relatively large and bulky, relatively expensive and consume undesirably large amounts of power. The result is that the use of non-permanently connected ground fault current interrupter circuits in this country has been greatly hindered.

Other countries which do not have the UL requirement for protection against a broken neutral exhibit the very large potential uses for such non-permanently connected circuits, as some of these countries use many times the number of non-permanently connected ground fault current interrupter circuits that are employed in the United States. Of course, the hazard exists in these countries of a dangerous fault condition being created by a broken neutral, and a certain number of injuries are encountered. Accordingly, these countries also need an effective and relatively inexpensive protection against a broken neutral conductor.

SUMMARY OF THE INVENTION

With the resettable circuit closing device of this invention, protection against a broken neutral conductor may be effectively realized with a much smaller package, at a much lower cost and at much lower power consumption then is currently available in non-permanently connected ground fault current interrupter circuits. In addition, the resettable circuit closing device of this invention has great utility in providing protection against undervoltage situations in many other environments.

These results are achieved by utilizing a manually resettable circuit closing device that uses mechanical energy to close the contacts. A solenoid energized from the power line, or from a line where an undervoltage condition is to be detected, is used only to provide an adjusting function to condition the device to close contacts to complete a load circuit, not to provide the energy to actually close the contacts. Accordingly, the power requirements of the solenoid are greatly reduced, which permits the utilization of a much smaller and less expensive solenoid arrangement.

The circuit closing device employs a reciprocable contact carrier that is mechanically biased to have the contacts in a normally open position. This contact carrier may take the form of a contact-carrying bar mounted in a cantilever fashion by flexible supporting legs that provide the bias to a normally open position.

An elongated actuating member is arranged to reciprocate adjacent the contact-carrying bar when manually energized through an appropriate push button. A mechanical actuating bias, such as a bias spring, is utilized to urge the actuating member to the rest position that it assumes prior to manual depression of the push button.

An extending shoulder or tang is formed or located on the actuating member adjacent the contact-carrying bar to engage or latch the contact-carrying bar. This extending shoulder or tang will not engage the contact-carrying bar unless the solenoid is energized.

The solenoid has a conventional coil and a reciprocable armature. The armature has a securing frame mounted on its free end to engage and hold the elongated actuating member when the coil is energized by a voltage in excess of a predetermined level, or a potential proportional to the line-to-neutral voltage of a power line protected by a ground fault current interrupter circuit.

A permanently fixed cam is utilized to mechanically flex the elongated actuating member, when that member is energized by manual depression of the push button, to place the extending shoulder or tang in position to engage the contact-carrying bar. This flexing action of the actuating member will also move the armature of the solenoid toward its energized position. If the solenoid coil is not energized by a voltage in excess of the predetermined minimum level, the force provided by the flexed actuating member, when it is removed from contact with the cam by the return action of the actuating bias spring, will return the armature to its de-energized position and the shoulder or tang will not engage the contact-carrying bar. However, if the solenoid coil is energized to magnetically bias the actuating member so that it is maintained in the flexed position, the contact-carrying bar will be engaged by the shoulder and the contacts will be closed by the force of the actuating bias spring. Since the closing of the contacts against the normally open bias is achieved through the force of the actuating bias spring, the power required by the solenoid coil is greatly reduced from that which would be required if the solenoid had to close the contacts.

Therefore, with the present invention, protection against a broken neutral in connection with a ground fault current interrupter circuit, or an undervoltage condition in another context, is provided by a relatively small, relatively inexpensive and relatively low power-consuming circuit closing device. This is achieved by converting the force provided by manual depression of a push button into mechanical energy for closing the circuit, so that the power consumed by the electrically energized coil is only that required for a holding action. In essence, the electrically energized solenoid assumes primarily an electrical condition detection function, while the greater force requirements are provided mechanically (as a result of manual energization).

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

A resettable contact closing device 11 is illustrated in detail in the various views of FIGS. 1–5. A base 13 provides a mounting structure for the other elements of the contact closing device 11. Base 13 is preferably formed of an insulating material and may take the form required to mount the components in a particular environment.

A casing 15 is secured to base 13 to movably mount a manually actuated button plunger 17. Casing 15 and plunger 17 may take any appropriate shape, such as a circular or square cross section, although in this preferred embodiment, as may be seen from a comparison of FIGS. 1 and 2, the housing and plunger button are illustrated as having a width dimension that is greater than the depth dimension.

Figure 1:
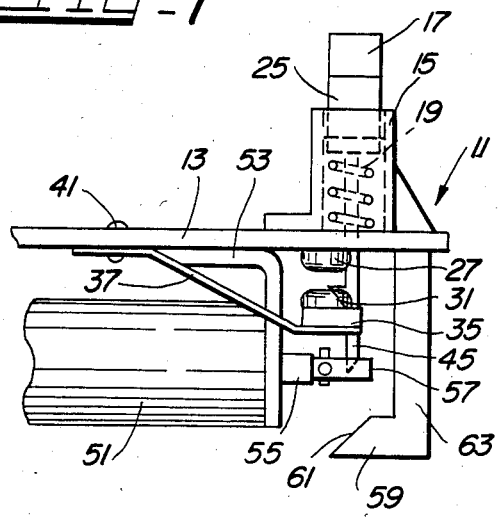
FIG. 1 is a side elevational view of a preferred embodiment of a resettable circuit closing device constructed in accordance with the present invention.
Figure 2:
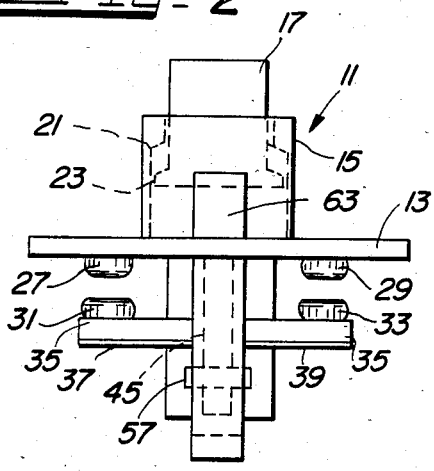
FIG. 2 is a front elevational view of the circuit closing device of FIG. 1.
Figure 3:
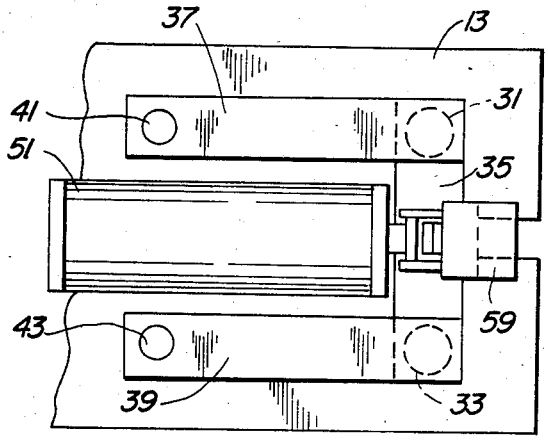
FIG. 3 is a bottom plan view of the circuit closing device of FIG. 1.

Plunger 17 is biased to the fully retracted rest position of FIG. 1 by an actuating bias spring 19. Plunger button 17 is retained in the casing 15, as may best be seen in FIG. 2, by a shoulder 21 in casing 15 that engages a projecting flange portion 23 on the end of plunger button 17. In the fully retracted rest position of FIG. 1, a display portion 25 of plunger button 17 may be utilized to indicate that the plunger is in its fully retracted rest position, which, as described hereinafter, means that the contacts of the circuit closing device 11 are open.

Stationary contacts 27 and 29 are mounted on the side of base 13 opposite the casing 15. Movable contacts 31 and 33 are mounted for a generally reciprocable motion toward and away from the fixed contacts 27 and 29.

Movable contacts 31 and 33 are mounted on a generally reciprocable contact carrier in the form of a bar 35. Contact-carrying bar 35 is supported by a pair of legs 37 and 39, the ends away from bar 35 of which are secured to base 13 by suitable attaching arrangements 41 and 43. Attachments 41 and 43 may be any type of devices that secure the legs 37 and 39 to the base, such as rivets or bolt and nut arrangements.

Legs 37 and 39 are formed from a resilient material; a suitable spring metal in this preferred embodiment. Accordingly, the resiliency of legs 37 and 39 opposes a force applied to move contacts 31 and 33 toward the stationary contacts 27 and 29, and hence legs 41 and 43 serve to bias the contacts toward the normally open position of FIGS. 1, 2 and 5. It may also be noted that due to cantilever mounting of the contact-carrying bar 35, there is a slight arcuate component to the reciprocation of bar 35 and contacts 31 and 33.

Figure 4:
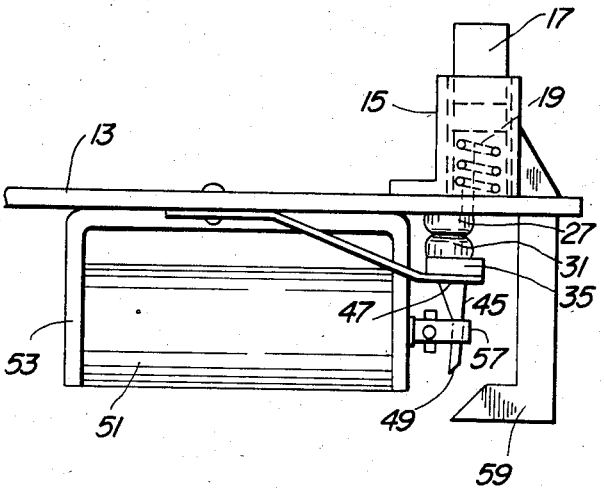
FIG. 4 is a side elevational view similar to that of FIG. 1, but with the contacts in a closed position.
Figure 5:
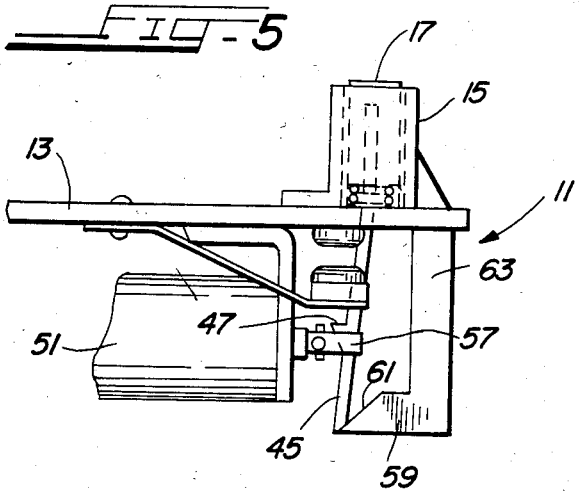
FIG. 5 is another side elevational view similar to FIGS. 1 and 4 showing the camming action on the actuator.

An elongated actuating member 45 is secured to and extends outwardly from plunger button 17. As best seen from a comparison of FIGS. 1 and 2, elongated actuating member 45 has a greater width dimension than depth dimension, in the same fashion as the plunger button 17 itself, in this preferred embodiment. A shoulder or tang 47 is formed on or connected to the actuating member 45, as best seen in FIG. 5. With reference to FIG. 4, it may be seen that the end of the elongated actuating member 45 is, in this preferred embodiment, provided with a surface 49 at an acute angle with respect to the axis of the actuating member 45.

Elongated actuating member 45 is relatively rigid, but it is formed of a material such that it has some ability to flex. When the elongated actuating member 45 is not flexed, manual energization of the button 17 produces reciprocation of member 45 without the shoulder or tang 47 engaging the contact-carrying bar 35. However, if the actuating member 45 is maintained in the flexed position illustrated in FIG. 5, shoulder 47 will engage the contact-carrying bar 35. In this latched position, the actuating bias spring 19 will cause the contacts to be closed, as shown in FIG. 4.

A solenoid 51 is mounted on base 13 by a suitable mounting frame or structure 53. Solenoid 51 has a conventional coil and an armature 55. Armature 55 of solenoid 51 has a securing frame 57 secured to the end thereof. Securing frame 57 is generally U-shaped and is adapted to engage elongated actuating member 45 when solenoid 51 is energized.

The coil of solenoid 51 is connected across the two leads of a power line, when it is utilized in connection with a ground fault current interrupter circuit, or across a circuit in which undervoltage conditions are being monitored in other applications. Thus, solenoid 51 will be electromagnetically energized to retract armature 55 in the event that a voltage in excess of a predetermined minimum level (e.g., zero in the case of a broken neutral lead of a power line), but will not be energized if there is no voltage or if it falls below the predetermined minimum level.

When solenoid 51 is energized, armature 55 is retracted so that the securing frame 57 maintains the elongated actuating member 45 in the flexed positions illustrated in FIGS. 4 and 5.

Solenoid 51 could be utilized to flex the actuating member 45, but this could result in an undesired increase in the size of the solenoid 51. Accordingly, a cam 59 having a cam surface 61 is provided to engage surface 49 on the elongated actuating member 45 to produce the flexure depicted in FIG. 5. Thus, the solenoid 51 only needs to provide enough force to maintain member 45 in the flexed position.

Cam 59 may be mounted in any suitable fashion to achieve the desired flexing of member 45, such as by the mounting arm 63 secured to base 13 utilized in the preferred embodiment disclosed herein. However, any other appropriate fashion of mounting the cam 59 could be employed.

With the arrangement depicted herein, depression of the plunger button 17 will result in the elongated actuating member 45 being flexed to the position of FIG. 5. If the solenoid 51 is not energized, release of the button 17 will result in the actuating member 45 returning to the rest position of FIG. 1 under the impetus of actuating bias spring 19. However, if solenoid 51 has been energized so that armature 55 has been electromagnetically retracted, securing frame 57 will engage member 45 and maintain it in the flexed position. This results in shoulder 47 on member 45 engaging the contact-carrying bar 35 to close the contacts, as illustrated in FIG. 4. In the event that the solenoid 51 is de-energized, the force provided by the flexing of the elongated actuating member 45 will remove shoulder 47 from the contact-carrying bar 35, so that the actuating member 45 will return to the fully retracted rest position and the contacts will return to the normally open position.

In this fashion, utilization of the circuit closing device of this invention means that if the neutral lead of a power line protected by a ground fault current interrupter circuit is broken, even if the voltage still appears on the "hot" lead, the solenoid will be de-energized and the contacts cannot be closed, or if already closed, they will open. In other environments, the same type of operation would occur if the solenoid 51 were energized from another circuit in which an undervoltage condition were being detected, in order to open an associated circuit if the voltage fell below a predetermined minimum level in the circuit being monitored.

Since the solenoid need only hold the actuating member in the flexed position, not actually move it to the flexed position, and since the circuit closing action is achieved by the mechanical force of biasing spring 19, the solenoid can be quite small. This means that the solenoid will be less expensive and will consume less energy from the power line, in comparison to currently utilized devices.

It should be understood that various modifications, changes and variations may be made in the arrangement, operation and details of construction of the elements disclosed herein without departing from the spirit and scope of this invention.

I claim:

1. A resettable circuit closing device that is opened in the event of an undervoltage condition comprising:
- contact means biased to a normally open position;
- mechanical actuating means for mechanically forcing said contact means to a closed position when in a flexed position;
- adjusting cam means flexing said actuating means to said flexed position; and
- electrically energized holding means engaging said actuating means to permit closing of said contact means, by keeping said actuating means in the flexed position after flexing by said adjusting means only when a voltage applied across said holding means exceeds a predetermined level.

2. A circuit closing device as claimed in claim 1 where:
- said contact means comprises a reciprocable contact carrier; and
- said actuating means comprises latching means to engage said contact carrier to close said contact means upon energization of said actuating means and to maintain said contact means closed, when said holding means has a voltage in excess of said predetermined level applied thereacross, and to permit said contact means to return to the normally open position when the voltage applied across said holding means does not exceed said predetermined level.

3. A resettable circuit closing device that is opened in the event of an undervoltage condition comprising:
- contact means biased to a normally open position, said contact means comprising a reciprocable contact carrier;
- mechanical actuating means comprising a reciprocable elongated member for mechanically forcing said contact means to a closed position;
- electrically energized holding means to enable said actuating means to close said contact means only when a voltage applied across said holding means exceeds a predetermined level; and
- latching means comprising a shoulder extending from said elongated member, said shoulder passing said contact carrier without engaging it upon reciprocation of said elongated member unless a voltage in excess of said predetermined level is applied across said holding means, said elongated member being biased to an actuating position by said holding means to cause said shoulder to engage said contact carrier when the voltage applied to said holding means exceeds said predetermined level, and a biasing force exerted causing said shoulder to disengage said contact carrier if the voltage applied to said holding means is below said predetermined level.

4. A circuit closing device as claimed in claim 3 and further comprising cam means to flex said elongated member to bring said shoulder into position to engage said contact carrier, so that said holding means need only be sufficiently strong to maintain said elongated member in the flexed position.

5. A circuit closing device as claimed in claim 4 wherein said holding means comprises:
- a solenoid having a coil to which the voltage is applied and a reciprocable armature; and
- a securing member mounted on said armature to hold said elongated member in the flexed position when a voltage in excess of said predetermined level is applied to the coil of said solenoid.

6. A resettable circuit closing device for opening a line protected by a ground fault current interrupter circuit in the event of a broken neutral conductor comprising:
- contact means biased to a normally open position, said contact means comprising a reciprocable contact carrier;
- mechanical actuating means for closing said contact means;
- adjusting means to condition said actuating means for closing said contact means; and electrically energized holding means to keep said actuating means conditioned for closing said contact means after conditioning by said adjusting means, said actuating means comprising latching means to engage said contact carrier to close said contact means upon energization of said actuating means and maintain said contact means closed, when said holding means is energized, and to not engage said contact carrier to permit said contact means to return to, or remain in, the normally open position when said holding means is not energized.

7. A circuit closing device as claimed in claim 6 wherein:

said actuating means comprises a reciprocable elongated member;

said latching means is a shoulder extending from said elongated member;

said shoulder passes said contact carrier without engaging it upon reciprocation of said elongated member unless said holding means is energized; and said elongated member is maintained in a flexed position to cause said shoulder to engage said contact carrier when said holding means is energized, and the force exerted by the flexed elongated member causes said shoulder to disengage said contact carrier if said holding means is de-energized.

8. A circuit closing device as claimed in claim 7 wherein said adjusting means comprises a cam to flex said elongated member, upon energization of said actuating means, to bring said shoulder into position to engage said contact carrier, so that said holding means need only be sufficiently strong to maintain said elongated member in the flexed position.

9. A circuit closing device as claimed in claim 8 wherein said holding means comprises:

a solenoid having a coil across which a potential proportional to the line-to-neutral voltage is applied and a reciprocable armature; and a securing member mounted on said armature to hold said elongated member in the flexed position when the potential proportional to the line-to-neutral voltage is applied across said coil of said solenoid.

10. A resettable circuit closing device, for use in connection with a power line having a ground fault current interrupter circuit, to open a load circuit in the event of a broken neutral conductor comprising:

contact means to complete the load circuit when closed;

mechanical contact bias means to urge said contact means to an open position;

manually energizable mechanical reset actuating means to close said contact means;

latching means associated with said reset actuating means;

electrically energized holding means to provide a magnetic bias when energized by a potential proportional to the line-to-neutral voltage to maintain said reset actuating means with said latching means positioned to close said contact means when said holding means is energized; and latching release means associated with said reset actuating means to reposition said latching means to permit said contact bias means to open said contact means when said holding means discontinues providing the magnetic bias.

11. A circuit closing device as claimed in claim 10 wherein:

said reset actuating means comprises an elongated actuating member mounted for reciprocable motion upon manual energization thereof and mechanical actuating bias means to urge said actuating member to its fully retracted reset position; and said latching means comprises a shoulder located on said actuating member.

12. A circuit closing device as claimed in claim 11 wherein said contact means comprises a reciprocable contact carrier to be engaged by said shoulder when said actuating means is maintained in a flexed position by said holding means.

13. A circuit closing device as claimed in claim 12 wherein said latching release means comprises the force produced by flexure of said actuating member.

14. A circuit closing device as claimed in claim 13 and further comprising a cam to engage and flex said actuating member upon manual energization thereof.

15. A circuit closing device as claimed in claim 12 wherein holding means comprises:

a solenoid having a coil and an armature; and a securing frame mounted on said armature to hold said elongated member in the flexed position when the coil of said solenoid is energized by a potential proportional to the line-to-neutral voltage.

16. A resettable circuit closing device for use in connection with a ground fault current interrupter circuit to open a power line to a load in the event of a broken neutral conductor comprising:

a reciprocable contact-carrying bar mechanically biased to have the contacts normally open;

a manually energizable elongated actuating member mounted for reciprocation past said contact-carrying bar, said actuating member having at least some flexibility;

mechanical actuating bias means forcing said actuating member to return to its rest position;

a latching shoulder mounted on said actuating member adjacent said contact-carrying bar;

cam means to flex said actuating member to place said shoulder in position to engage said contact-carrying bar;

a solenoid having a coil across which a potential proportional to the power line-to-neutral voltage is applied and a reciprocable armature; and a securing frame mounted on said armature to engage and hold said actuating member in the flexed position when said coil of said solenoid is energized, after said actuating member has been flexed by said cam means to mechanically force said armature to the energized position, whereby said latching shoulder is brought into, and held in, engagement with said contact-carrying bar to close said contacts and maintain said contacts closed so long as said coil of said solenoid is energized, the force exerted by the flexed actuating member removing said latching shoulder from said contact-carrying bar when said coil is de-energized, to thereby open the contacts.

* * * * *